US008460847B2

(12) United States Patent
Shirai et al.

(10) Patent No.: US 8,460,847 B2
(45) Date of Patent: Jun. 11, 2013

(54) TONERS FOR ELECTROPHOTOGRAPHY

(75) Inventors: Eiji Shirai, Wakayama (JP); Takashi Kubo, Wakayama (JP); Hiroshi Mizuhata, Wakayama (JP); Shoichi Murata, Wakayama (JP)

(73) Assignee: Kao Corporation, Tokyo (JP)

( * ) Notice: Subject to any disclaimer, the term of this patent is extended or adjusted under 35 U.S.C. 154(b) by 683 days.

(21) Appl. No.: 12/541,483

(22) Filed: Aug. 14, 2009

(65) Prior Publication Data

US 2010/0055595 A1 Mar. 4, 2010

(30) Foreign Application Priority Data

Aug. 26, 2008 (JP) ..... 2008-217230
Aug. 10, 2009 (JP) ..... 2009-185619

(51) Int. Cl.
*G03G 9/08* (2006.01)

(52) U.S. Cl.
USPC ..... 430/110.2; 430/109.1; 430/137.14

(58) Field of Classification Search
USPC ..... 430/109.4, 137.14, 110.2
See application file for complete search history.

(56) References Cited

U.S. PATENT DOCUMENTS

| | | | | |
|---|---|---|---|---|
| 5,981,128 | A * | 11/1999 | Tavernier et al. | 430/109.2 |
| 7,351,510 | B2 | 4/2008 | Shirai et al. | |
| 7,387,863 | B2 | 6/2008 | Shirai et al. | |
| 7,390,605 | B2 | 6/2008 | Shirai | |
| 2005/0074685 | A1 * | 4/2005 | Kido et al. | 430/110.2 |
| 2005/0271965 | A1 * | 12/2005 | Kamiyoshi et al. | 430/111.4 |
| 2006/0105258 | A1 * | 5/2006 | Ishiyama et al. | 430/108.4 |
| 2007/0207401 | A1 | 9/2007 | Shirai | |
| 2008/0153027 | A1 * | 6/2008 | Veregin et al. | 430/113 |

OTHER PUBLICATIONS

U.S. Appl. No. 13/061,912, filed Mar. 2, 2011, Murata, et al.
U.S. Appl. No. 13/133,528, filed Aug. 18, 2011, Shirai, et al.

* cited by examiner

*Primary Examiner* — Jonathan Jelsma
(74) *Attorney, Agent, or Firm* — Oblon, Spivak, McClelland, Maier & Neustadt, L.L.P.

(57) ABSTRACT

The present invention relates to a toner for electrophotography including a polyester obtained by subjecting a crystalline polyester-containing aqueous dispersion and a non-crystalline polyester-containing aqueous dispersion to aggregation and coalescence, as a resin binder, wherein the crystalline polyester is produced by polycondensing an alcohol component containing 70 mol % or more of an aliphatic diol having 2 to 8 carbon atoms with a carboxylic acid component containing 50 mol % or more of terephthalic acid. The toner is excellent in low-temperature fusing ability and pressure storage stability.

6 Claims, No Drawings

TONERS FOR ELECTROPHOTOGRAPHY

CROSS REFERENCES TO RELATED APPLICATIONS

This application claims priority to Japanese Patent Application No. 2008-217230, filed on Aug. 26, 2008, and Japanese Patent Application No. 2009-185619, filed on Aug. 10, 2009.

FIELD OF THE INVENTION

The present invention relates to toners for electrophotography which are employed in electrophotography, an electrostatic recording method, an electrostatic printing method or the like, and a process for producing a resin binder for the toners.

BACKGROUND OF THE INVENTION

In recent years, there is a demand for development of toners having excellent fusing ability and storage stability, etc., from the viewpoint of achieving higher image qualities.

As toners having not only a good low-temperature fusing ability but also a good charging property, there is disclosed a toner using a resin binder which contains a crystalline polyester whose surface is coated with an amorphous polymer (JP 2004-191927A). Also, there are disclosed a toner which is improved in fusing ability by an emulsification and aggregation method including a step of causing fusion between fine particles (JP 2007-248666A), and a toner which is improved in fusing ability or long-term storage property by using, as a resin binder, fine particles prepared by dispersing a polyester in water for dissolution and reduction in viscosity (JP 2005-128176A).

In addition, in order to provide good images which are kept stable even when used for a long period of time, there is disclosed a process for producing a toner for development of electrostatic latent images which process includes an aggregating step of mixing a dispersion in which non-crystalline polyester resin particles are dispersed and a dispersion in which crystalline polyester resin particles are dispersed, with each other to form aggregated particles; and a fusing/coalescing step of heating the resulting aggregated particles at a temperature not lower than a glass transition temperature of the non-crystalline polyester resin to obtain fused and unified particles thereof, wherein a mixture of the non-crystalline polyester resin and the crystalline polyester resin has a specific weight-average molecular weight (Mw) and a specific ratio of the weight-average molecular weight (Mw) to a number-average molecular weight (Mn) (Mw/Mn) (JP 2008-158197A).

SUMMARY OF THE INVENTION

The present invention relates to the following toners for electrophotography and the following process for producing a resin binder for toners for electrophotography.

(1) A toner for electrophotography including a polyester obtained by subjecting a crystalline polyester-containing aqueous dispersion and a non-crystalline polyester-containing aqueous dispersion to aggregation and coalescence, as a resin binder, wherein the crystalline polyester is produced by polycondensing an alcohol component containing 70 mol % or more of an aliphatic diol having 2 to 8 carbon atoms with a carboxylic acid component containing 50 mol % or more of terephthalic acid.

(2) A toner for electrophotography including core-shell particles as a resin binder, wherein the core-shell particles each include a core portion obtained by subjecting a crystalline polyester-containing aqueous dispersion and a non-crystalline polyester-containing aqueous dispersion to aggregation, the crystalline polyester being produced by polycondensing an alcohol component containing 70 mol % or more of an aliphatic diol having 2 to 8 carbon atoms with a carboxylic acid component containing 50 mol % or more of terephthalic acid; and a shell portion including a non-crystalline polyester.

(3) A process for producing a resin binder for toners for electrophotography, including the following steps (1') to (3'):

(1') mixing an aqueous dispersion containing a crystalline polyester produced by polycondensing an alcohol component containing 70 mol % or more of an aliphatic diol having 2 to 8 carbon atoms with a carboxylic acid component containing 50 mol % or more of terephthalic acid, with an aqueous dispersion containing a non-crystalline polyester to subject these dispersions to aggregation, thereby obtaining an aqueous dispersion of resin particles A;

(2') mixing the aqueous dispersion of resin particles A obtained in the step (1') with an aqueous dispersion containing a non-crystalline polyester to subject these dispersions to aggregation, thereby obtaining an aqueous dispersion of resin particles B; and (3') coalescing the resin particles B obtained in the step (2').

DETAILED DESCRIPTION OF THE INVENTION

In the emulsification and aggregation method, since a shearing force is hardly applied to the particles upon mixing usually, it has been difficult to finely disperse the crystalline polyester in the non-crystalline resin, thereby it has been difficult to provide a toner for electrophotography which is excellent in low-temperature fusing ability (hereinafter occasionally referred to merely as a "fusing ability") and pressure storage stability.

In accordance with the present invention, there is provided a toner for electrophotography which is excellent in fusing ability and pressure storage stability. The toners for electrophotography according to the present invention can be suitably used for development of latent images formed in electrophotography, an electrostatic recording method, an electrostatic printing method or the like owing to excellent low-temperature fusing ability and pressure storage stability thereof.

[Resin Binder]

The toners for electrophotography according to the present invention contain a crystalline polyester and a non-crystalline polyester as a resin binder.

The crystalline polyester as used in the present invention means a resin having a ratio of a softening point to an endothermic maximum peak temperature (softening point (° C.)/endothermic maximum peak temperature (° C.)) of from 0.6 to 1.3, preferably from 0.9 to 1.2, and more preferably more than 1 and not more than 1.2.

On the other hand, the non-crystalline polyester as used herein means a 30 resin having a ratio of a softening point to an endothermic maximum peak temperature (softening point (° C.)/endothermic maximum peak temperature (° C.)) of more than 1.3 and not more than 4 and preferably from 1.5 to 3.

Meanwhile, in the present invention, the term "polyester" solely as used herein means both the crystalline polyester and the non-crystalline polyester.

(Crystalline Polyester)

The crystalline polyester used in the present invention is a resin produced by polycondensing an alcohol component containing 70 mol % or more of an aliphatic alcohol having 2 to 8 carbon atoms with a carboxylic acid component containing 50 mol % or more of terephthalic acid.

According to the present invention, an aqueous dispersion of a specific crystalline polyester and an aqueous dispersion of a non-crystalline polyester are subjected to an emulsification and aggregation method including aggregation and coalescence steps (hereinafter occasionally referred to merely as "emulsification and aggregation method") to thereby obtain a toner for electrophotography which is excellent in fusing ability and pressure storage stability.

The reason therefor is considered as follows. That is, when the aqueous dispersion of the specific crystalline polyester produced from an alcohol component containing 70 mol % or more of an aliphatic alcohol having 2 to 8 carbon atoms and a carboxylic acid component containing 50 mol % or more of terephthalic acid is emulsified and aggregated with the aqueous dispersion of a non-crystalline polyester, the crystalline polyester can be finely dispersed in the non-crystalline polyester.

Examples of the aliphatic diol having 2 to 8 carbon atoms include ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol and 1,4-butenediol. Among these aliphatic diols, from the viewpoints of excellent fusing ability and pressure storage stability of the resulting toner owing to enhanced dispersibility of the crystalline polyester (hereinafter occasionally referred to merely as "fusing ability and pressure storage stability"), preferred are aliphatic diols having 2 to 6 carbon atoms; more preferred are aliphatic diols having 3 to 6 carbon atoms. In addition, preferred are α,ω-linear alkanediols having 2 to 5 carbon atoms; and more preferred is 1,6-hexanediol.

The content of the aliphatic diol having 2 to 8 carbon atoms and preferably the α,ω-linear alkanediol in the alcohol component is 70 mol % or more, preferably from 80 to 100 mol % and more preferably from 90 to 100 mol % from the same viewpoints as described above.

In particular, the content of 1,6-hexanediol in the alcohol component is preferably 50 mol % or more and more preferably from 60 to 100 mol %.

Also, from the viewpoints of a good fusing ability and a good crystallizability, the aliphatic diol is preferably in the form of a mixture of 2 or more kinds of the above aliphatic diols which are different in carbon number from each other, more preferably 2 to 5 kinds of the above aliphatic diols which are different in carbon number from each other, and even more preferably 2 or 3 kinds of the above aliphatic diols which are different in carbon number from each other.

From the viewpoints of a good fusing ability and a good pressure storage stability, the aliphatic diol preferably contains at least 1,6-hexanediol, and more preferably contains 1,6-hexanediol and the α,ω-linear alkanediol other than 1,6-hexanediol preferably having 2 to 5 carbon atoms and more preferably 3 to 5 carbon atoms. When the aliphatic diol is in the form of a mixture of 1,6-hexanediol and the α,ω-linear alkanediol having 2 to 5 carbon atoms, the weight ratio between both the diols (1,6-hexanediol/α,ω-linear alkanediol) is preferably from 40/60 to 90/10, more preferably from 50/50 to 85/15 and even more preferably from 55/45 to 80/20.

Examples of the polyhydric alcohol other than the aliphatic diol having 2 to 8 carbon atoms which may be contained in the alcohol component include aromatic diols such as an alkylene oxide adduct of bisphenol A such as a polyoxypropylene adduct of 2,2-bis(4-hydroxyphenyl)propane and a polyoxyethylene adduct of 2,2-bis(4-hydroxyphenyl)propane; and trivalent or higher-valent alcohols such as glycerol, pentaerythritol and trimethylol propane.

The content of terephthalic acid in the carboxylic acid component is 50 mol % or more, preferably from 60 to 100 mol %, more preferably from 70 to 100 mol %, even more preferably from 80 to 100 mol % and further even more preferably from 90 to 100 mol % from the viewpoints of a good fusing ability and a good pressure storage stability of the resulting toner. Meanwhile, the terephthalic acid used in the present invention involves derivatives of terephthahic acid which are capable of forming the same constitutional unit as that derived from terephthalic acid by condensation reaction, for example, $C_1$ to $C_3$ alkyl esters of terephthalic acid. Examples of the alkyl group contained in the alkyl esters include a methyl group, an ethyl group, a propyl group and an isopropyl group.

The carboxylic acid component may also contain, in addition to terephthalic acid, other aromatic dicarboxylic acid compounds. Examples of the other aromatic dicarboxylic acid compounds include phthalic acid, isophthalic acid and anhydrides and alkyl ($C_1$ to $C_3$) esters of these acids. Among these aromatic dicarboxylic acid compounds, preferred is isophthalic acid. Meanwhile, the "aromatic dicarboxylic acid compound" as used herein means an aromatic dicarboxylic acid as well as an anhydride and an alkyl ($C_1$ to $C_3$) ester thereof. Among these compounds, preferred are aromatic dicarboxylic acids.

In the present invention, since terephthalic acid is used in the carboxylic acid component of the crystalline polyester, the resulting toner can be improved in charging stability. When comparing the crystalline polyester of the present invention with those crystalline polyesters using an aliphatic dicarboxylic acid compound as a main component of the carboxylic acid component and having the substantially same softening point, the toner obtained by using the crystalline polyester of the present invention can exhibit a more remarkable effect of enhancing a low-temperature fusing ability.

Examples of the polycarboxylic acid compound other than the aromatic dicarboxylic acid compound which may be contained in the carboxylic acid component include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid and n-dodecenylsuccinic acid; alicyclic dicarboxylic acids such as cyclohexanedicarboxylic acid; trivalent or higher-valent polycarboxylic acids such as trimellitic acid and pyromellitic acid; and anhydrides and alkyl ($C_1$ to $C_3$) esters of these acids.

In addition, from the viewpoint of well controlling a molecular weight of the resulting polyester, etc., the alcohol component and/or the carboxylic acid component may also contain an appropriate amount of a monovalent alcohol or a monovalent carboxylic acid compound unless the inclusion thereof adversely affects the aimed effects of the present invention. When using a monovalent aliphatic alcohol preferably having 8 to 24 carbon atoms and more preferably 12 to 18 carbon atoms in the alcohol component, the resulting toner can be enhanced in fluidity, so that solid images when printed therewith can be improved in reproducibility and, therefore, can be prevented from suffering from fading or lacking. The reason therefor is considered as follows. That is, it is considered that when subjecting the aqueous dispersion containing the crystalline polyester and the aqueous dispersion containing the non-crystalline polyester to aggregation and coalescence, the crystalline polyester can be readily incorporated in the non-crystalline polyester. The content of the monovalent alcohol in the alcohol component is preferably from 2 to 20 mol % and more preferably from 4 to 15 mol %.

The total molar amount of terephthahc acid and 1,6-hexanediol in the carboxylic acid component and the alcohol component constituting the crystalline polyester is preferably from 75 to 95 mol % and more preferably from 75 to 85 mol % on the basis of a total molar amount of the carboxylic acid component and the alcohol component of the crystalline polyester from the viewpoints of attaining excellent fusing ability and pressure storage stability of the resulting toner by enhancing a dispersibility of the crystalline polyester while keeping a satisfactory softening point thereof.

The molar ratio of the carboxylic acid component to the alcohol component (carboxylic acid component/alcohol component) in the crystalline polyester is controlled such that the amount of alcohol component is larger than that of the carboxylic acid component when it is intended to increase a molecular weight of the crystalline polyester, and further is controlled to preferably not less than 0.9 but less than 1 and more preferably not less than 0.95 but less than 1 from the viewpoint of a capability of readily controlling the molecular weight of the polyester by distilling off the alcohol component upon the reaction in vacuo.

In the present invention, from the viewpoints of a good fusing ability and a good pressure storage stability of the resulting toner, the number-average molecular weight of the crystalline polyester is preferably 2,000 or more and more preferably 4,000 or more. However, in view of a good productivity of the crystalline polyester, the number-average molecular weight thereof is preferably 10,000 or less, more preferably 9,000 or less and even more preferably 8,000 or less.

From the same viewpoint as that for the number-average molecular weight of the crystalline polyester, the lower limit of the weight-average molecular weight of the crystalline polyester is preferably 9,000 or more, more preferably 20,000 or more and even more preferably 60,000 or more, and the upper limit of the weight-average molecular weight is preferably 10,000,000 or less, more preferably 6,000,000 or less, even more preferably 4,000,000 or less, further even more preferably 1,000,000 or less and still further even more preferably 200,000 or less.

Meanwhile, in the present invention, the number-average molecular weight and the weight-average molecular weight of the crystalline polyester both are the values as measured with respect to chloroform-soluble components contained therein.

In order to obtain the crystalline polyester having such a high molecular weight, the molar ratio between the carboxylic acid component and the alcohol component may be controlled as described above, or the suitable reaction conditions such as increase in reaction temperature, increase in amount of the catalyst used, reaction under reduced pressure, and long dehydration reaction time may be appropriately selected. In addition, the crystalline polyester having the high molecular weight may also be produced by using a high-output motor. However, in the case where the polyester is to be produced without selection of any special production facilities, it is effective to use such a method in which the raw monomers are reacted in the presence of a non-reactive low-viscous resin or a solvent.

In the present invention, from the viewpoint of finely dispersing the crystalline polyester in the non-crystalline polyester by the emulsification and aggregation method and thereby enhancing a fusing ability and a pressure storage stability of the resulting toner, the melting point of the crystalline polyester is preferably from 70 to 130° C., more preferably from 70 to 120° C., even more preferably from 80 to 120° C., even more preferably from 80 to 110° C., further even more preferably from 90 to 110° C. and still further even more preferably from 90 to 100° C.

From the viewpoint of a good fusing ability, the softening point of the crystalline polyester is preferably from 60 to 120° C., more preferably from 70 to 115° C., even more preferably from 70 to 110° C. and further even more preferably from 85 to 95° C.

The melting point and the softening point of the crystalline polyester may be readily controlled by suitably adjusting a composition of the raw monomers, a polymerization initiator, a molecular weight of the polyester, an amount of the catalyst used, etc., or suitably selecting the reaction conditions.

When subjecting the crystalline polyester of the present invention to the thermal process using a differential scanning colorimeter (DSC) in which the polyester after being allowed to stand at 50° C. for one week is heated from 0 to 180° C. at a temperature rise rate of 10° C./min (1st RUN) and then cooled from 180 to 0° C. at a temperature drop rate of 10° C./min (2nd RUN), the following formula is preferably satisfied:

$$X/Y=0.2 \text{ or less}$$

(wherein X is an area of an endothermic peak observed in the 1st RUN; and Y is an area of an exothermic peak observed in the 2nd RUN).

The condition capable of satisfying the above formula means that after dissolving the crystalline polyester in the 1st RUN, a rate of precipitation of crystals from the resulting solution in the 2nd RUN is low, i.e., a rate of production of crystals at the stage of forming an aqueous dispersion of the crystalline polyester as described below is low. When the production of crystals at this stage is suppressed, the below-mentioned aqueous dispersion of the non-crystalline polyester or additives such as a colorant can be readily mixed and dispersed in the crystalline polyester, so that the resulting toner is excellent in fusing ability and pressure storage stability.

The ratio X/Y is preferably 0.2 or less and more preferably 0.1 or less.

In addition, when the crystalline polyester is heated again from 0 to 180° C. at a temperature rise rate of 10° C./min using DSC (3rd RUN), the crystals precipitated are preferably dissolved, and both an endothermic peak and an exothermic peak are preferably observed during the DSC measurement.

The ratio of an area of the exothermic peak observed in the 3rd RUN to that of the endothermic peak observed in the 1st RUN is preferably 0.2 or more, and more preferably 0.5 or more:

$$Z/X=0.2 \text{ or more}$$

(wherein X is an area of an endothermic peak observed in the 1st RUN; and Z is an area of an exothermic peak observed in the 3rd RUN).

Under the condition capable of satisfying the above formula, the crystalline polyester can be readily aggregated and unified with the non-crystalline polyester or the additives such as a colorant, so that the resulting toner is excellent in fusing ability and pressure storage stability. Meanwhile, the detailed conditions of DSC measurement are described below in the Examples.

(Non-Crystalline Polyester)

The non-crystalline polyester used in the present invention is preferably a resin containing a polyester component produced by polycondensing an alcohol component containing 70 mol % or more of an alkyleneoxide adduct of bisphenol A represented by the following formula (I) (referred to as a "bisphenol A skeleton") or an aliphatic diol having 2 to 10 carbon atoms with a carboxylic acid component.

In the following formula (I), R is an alkylene group having 2 or 3 carbon atoms; x and y are respectively a positive number with the proviso that a sum of x and y is from 1 to 16 and preferably from 1.5 to 5.

(I)

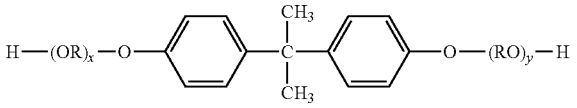

Specific examples of the alkyleneoxide adduct of bisphenol A represented by the above formula (I) include a polyoxypropylene adduct of 2,2-bis(4-hydroxyphenyl)propane and a polyoxyethylene adduct of 2,2-bis(4-hydroxyphenyl)propane.

In addition, specific examples of the aliphatic diols having 2 to 10 carbon atoms include ethylene glycol, 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol. Among these aliphatic diols, preferred are aliphatic diols having 2 to 8 carbon atoms, more preferred are aliphatic diols having 3 to 6 carbon atoms, and even more preferred is 1,2-propanediol.

The content of the alkyleneoxide adduct of bisphenol A or the aliphatic diol having 2 to 10 carbon atoms in the alcohol component is preferably 70 mol % or more, more preferably from 80 to 100 mol % and even more preferably from 90 to 100 mol %. In the present invention, when using the alkyleneoxide adduct of bisphenol A, the resulting toner can be improved in environmental stability. Further, the toner can also be improved in anti-blocking property under the condition of applying a constant pressure thereto, although the reason therefor has not been clearly determined.

Examples of the alcohols other than the alkyleneoxide adduct of bisphenol A and the aliphatic diol having 2 to 10 carbon atoms which may be contained in the alcohol component include the same trivalent or higher-valent alcohols as used in the crystalline polyester.

The carboxylic acid component of the non-crystalline polyester preferably contains an aromatic dicarboxylic acid compound including terephthalic acid similarly to that of the crystalline polyester, from the viewpoint of finely dispersing the crystalline polyester in the non-crystalline polyester and thereby improving a fusing ability and a pressure storage stability of the resulting toner. Examples of the aromatic dicarboxylic acid include terephthalic acid as well as the same aromatic dicarboxylic acids as used for the crystalline polyester. The non-crystalline polyester is preferably obtained by polycondensing the carboxylic acid component containing the aromatic dicarboxylic acid compound including terephthalic acid, preferably terephthalic acid, in an amount of preferably 10 mol % or more, more preferably from 30 to 100 mol %, even more preferably from 50 to 100 mol %, further even more preferably from 50 to 90 mol % and still further even more preferably from 60 to 90 mol %, with the alcohol component, from the viewpoints of a good fusing ability and a good pressure storage stability.

As the polycarboxylic acid compound other than the aromatic dicarboxylic acid compound which may be contained in the carboxylic acid component, there may be mentioned the same polycarboxylic acid compounds as used in the crystalline polyester.

Meanwhile, in the present invention, the non-crystalline polyester containing a polyester component obtained by polycondensing the alcohol component with the carboxylic acid component may include not only a resin containing the above polyester component but also a modified resin thereof.

Examples of the modified polyester resin include urethane-modified polyesters obtained by modifying the polyester component with a urethane bond, epoxy-modified polyesters obtained by modifying the polyester component with an epoxy bond, and hybrid resins containing two or more kinds of resin components including the polyester component.

The non-crystalline polyester used in the present invention may be constituted of either one or both of the resin containing the above polyester component and the modified resin thereof. More specifically, the non-crystalline polyester may be the polyester component solely and/or a hybrid resin composed of the polyester component and a vinyl-based resin component.

The hybrid resin composed of the polyester component and the vinyl-based resin component may be produced by any of a method of melt-kneading the respective resins, if required, in the presence of an initiator, a method of dissolving the respective resins in a solvent and mixing the resulting solutions with each other, a method of polymerizing a mixture of raw monomers for the respective resins with each other, etc. The hybrid resin is preferably produced by a method of subjecting raw monomers for the polyester component and raw monomers for the vinyl-based resin component to polycondensation reaction and addition polymerization reaction, respectively (JP 7-98518A).

Examples of the raw monomers for the vinyl-based resin component include styrene compounds such as styrene and α-methyl styrene; ethylenically unsaturated monoolefins such as ethylene and propylene; diolefins such as butadiene; halovinyl compounds such as vinyl chloride; vinyl esters such as vinyl acetate and vinyl propionate; esters of ethylenically monocarboxylic acids such as alkyl ($C_1$ to $C_{18}$) esters of (meth)acrylic acid and dimethylaminoethyl(meth)acrylate; vinyl ethers such as vinyl methyl ether; vinylidene halides such as vinylidene chloride; and N-vinyl compounds such as N-vinyl pyrrolidone. From the viewpoints of good reactivity, pulverizability and charging stability, among these monomers, preferred are styrene, butyl acrylate, 2-ethylhexyl acrylate and methyl methacrylate. In addition, the content of styrene and/or the (meth)acrylic acid alkyl ester in the vinyl-based resin component is preferably 50% by weight or more, and more preferably from 80 to 100% by weight.

Meanwhile, the raw monomers for the vinyl-based resin component may be polymerized, if required, in the presence of a polymerization initiator, a crosslinking agent, etc.

The weight ratio of the raw monomers for the polyester component to the raw monomers for the vinyl-based resin component (raw monomers for the polyester component/raw monomers for the vinyl-based resin component) is preferably from 55/45 to 95/5, more preferably from 60/40 to 95/5 and even more preferably from 70/30 to 90/10 from the viewpoint of forming a continuous phase of the polyester component.

From the viewpoint of a good fusing ability, the softening point of the non-crystalline polyester used in the present invention is preferably from 70 to 180° C. and more preferably from 100 to 160° C. From the viewpoint of a good fusing ability, the glass transition temperature of the non-crystalline polyester used in the present invention is preferably from 45 to 80° C. and more preferably from 55 to 75° C. Meanwhile, the glass transition temperature is a property inherent to non-crystalline resins, and distinguished from a maximum peak temperature owing to heat of fusion.

The number-average molecular weight of the non-crystalline polyester is preferably from 1,000 to 6,000 and more preferably from 2,000 to 5,000. Also, the lower limit of the weight-average molecular weight of the non-crystalline polyester is preferably 10,000 or more, more preferably 30,000 or more and even more preferably 100,000 or more, whereas the upper limit of the weight-average molecular weight thereof preferably 1,000,000 or less and more preferably 500,000 or less. Meanwhile, the number-average molecular weight and the weight-average molecular weight of the non-crystalline polyester both are the values as measured with respect to tetrahydrofuran-soluble components contained therein.

(Conditions of Polycondensation)

Upon production of any of the crystalline polyester and the non-crystalline polyester, the alcohol component and the carboxylic acid component are preferably subjected to polycondensation reaction in the presence of an esterification catalyst. Examples of the esterification catalyst suitably used in the polycondensation reaction include titanium compounds and tin (II) compounds containing no Sn—C bond. These titanium and tin compounds as the esterification catalyst may be respectively used alone or in combination of any two or more thereof.

The titanium compound is preferably a titanium compound having a Ti—O bond and more preferably a titanium compound containing an alkoxy group, an alkenyloxy group or an acyloxy group having 1 to 28 carbon atoms in total.

Specific examples of the titanium compound include titanium diisopropylate bis(triethanol aminate) [$Ti(C_6H_{14}O_3N)_2(C_3H_7O)_2$], titanium diisopropylate bis(diethanol aminate) [$Ti(C_4H_{10}O_2N)_2(C_3H_7O)_2$], titanium dipentylate bis(triethanol aminate) [$Ti(C_6H_{14}O_3N)_2(C_5H_{11}O)_2$], titanium diethylate bis(triethanol aminate) [$Ti(C_6H_{14}O_3N)_2(C_2H_5O)_2$], titanium dihydroxyoctylate bis(triethanol aminate) [$Ti(C_6H_{14}O_3N)_2(OHC_8H_{16}O)_2$], titanium distearate bis(triethanol aminate) [$Ti(C_6H_{14}O_3N)_2(C_{18}H_{37}O)_2$], titanium triisopropylate triethanol aminate [$Ti(C_6H_{14}O_3N)_1(C_3H_7O)_3$] and titanium monopropylate tris(triethanol aminate) [$Ti(C_6H_{14}O_3N)_3(C_3H_7O)_1$]. Among these titanium compounds, preferred are titanium diisopropylate bis(triethanol aminate), titanium diisopropylate bis(diethanol aminate) and titanium dipentylate bis(triethanol aminate). These titanium compounds are also available, for example, as commercial products marketed from Matsumoto Kosho Co., Ltd.

Specific examples of the other suitable titanium compounds include tetra-n-butyl titanate [$Ti(C_4H_9O)_4$], tetrapropyl titanate [$Ti(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$] and dimyristyl dioctyl titanate [$Ti(C_{14}H_{29}O)_2(C_8H_{17}O)_2$]. Among these other suitable titanium compounds, preferred are tetrastearyl titanate, tetramyristyl titanate, tetraoctyl titanate and dioctyldihydroxyoctyl titanate. These titanium compounds may be produced, for example, by reacting a titanium halide with a corresponding alcohol, and are also available as commercial products marketed from Nisso Co., Ltd.

Examples of the preferred tin (II) compound containing no Sn—C bond include tin (II) compounds having a Sn—O bond and tin (II) compounds having a Sn—X bond wherein X represents a halogen atom. Among these tin compounds, preferred are tin (II) compounds having a Sn—O bond.

Examples of the tin (II) compound having a Sn—O bond include tin (II) carboxylates containing a carboxyl group having 2 to 28 carbon atoms such as tin (II) oxalate, tin (II) diacetate, tin (II) dioctanoate, tin (II) dilaurate, tin (II) distearate and tin (II) dioleate; dialkoxy tin (II) containing an alkoxy group having 2 to 28 carbon atoms such as dioctyloxy tin (II), dilauryloxy tin (II), distearoxy tin (II) and dioleyloxy tin (II); tin (II) oxide; and tin (II) sulfate. Examples of the tin (II) compound having a Sn—X bond wherein X represents a halogen atom include tin (II) halides such as tin (II) chloride and tin (II) bromide. Among these tin (II) compounds, in view of a good charging raise-up effect and a good catalyst performance, preferred are fatty acid tin (II) salts represented by the formula: $(R^1COO)_2Sn$ (wherein $R^1$ is an alkyl or alkenyl group having 5 to 19 carbon atoms), dialkoxy tin (II) compounds represented by the formula: $(R^2O)_2Sn$ (wherein $R^2$ is an alkyl or alkenyl group having 6 to 20 carbon atoms), and tin (II) oxide represented by the formula: SnO, more preferred are fatty acid tin (II) salts represented by the formula: $(R^1COO)_2Sn$ and tin (II) oxide, and even more preferred are tin (II) dioctanoate, tin (II) distearate and tin (II) oxide.

The above titanium compounds and the tin (II) compounds may be respectively used alone or in combination of any two or more thereof.

The amount of the esterification catalyst being present in the reaction system is preferably from 0.01 to 1.0 part by weight and more preferably from 0.1 to 0.6 part by weight on the basis of 100 parts by weight of a total amount of the alcohol component and the carboxylic acid component.

The polycondensation of the alcohol component and the carboxylic acid component may be carried out, for example, at a temperature of 120 to 250° C. in an inert gas atmosphere in the presence of the above esterification catalyst.

More specifically, for example, the whole monomers may be charged at one time in order to enhance a strength of the obtained resin. Alternatively, there may also be used a method of first reacting the divalent monomers and then adding the trivalent or higher-valent monomers to the obtained product to react therewith in order to reduce an amount of low-molecular components therein. Further, the reaction may be promoted by reducing a pressure of the reaction system in the later half of the polymerization.

In order to stabilize a dispersing condition of the resin particles and attain a sharp particle size distribution of a toner having a small particle size, the acid value of each of the crystalline polyester and the non-crystalline polyester is preferably from 1 to 40 mg KOH/g, more preferably from 2 to 35 mg KOH/g and even more preferably from 3 to 30 mg KOH/g from the viewpoints of a good chargeability and a good hydrolysis resistance of the resulting toner.

In addition, the the crystalline polyester and the non-crystalline polyester preferably have a high solubility in an organic solvent.

In the toner for electrophotography according to the present invention, the weight ratio of the crystalline polyester to the non-crystalline polyester (crystalline polyester/non-crystalline polyester) is preferably from 5/95 to 50/50, more preferably from 10/90 to 40/60 and even more preferably from 15/85 to 35/65 from the viewpoints of a good low-temperature fusing ability and a good storage stability.

[Toner for Electrophotography]

The toner for electrophotography according to the present invention contains, as a resin binder, a polyester obtained by subjecting an aqueous dispersion containing the above crystalline polyester and an aqueous dispersion containing the above non-crystalline polyester to aggregation and coalescence. The resin binder may also contain resins other than the above polyesters unless the inclusion thereof adversely affects the aimed effects of the present invention.

Also, the toner for electrophotography according to the present invention may contain a resin binder obtained by a method of subjecting raw material components including the aqueous dispersion of the crystalline polyester and the aqueous dispersion of the non-crystalline polyester, if required, together with any suitable additives, to aggregating and coalescing step for forming aggregated and unified particles.

(Additives)

Examples of the additives which may be contained in the toner of the present invention include a colorant, a charge controlling agent, a releasing agent, a conductivity controlling agent, an extender pigment, a reinforcing filler such as fibrous substances, an antioxidant and an anti-aging agent. These additives may be used in the form of an aqueous dispersion.

The colorant is not particularly limited, and may be appropriately selected from known colorants according to the aimed applications or requirements. Specific examples of the colorant include various pigments such as carbon blacks, inorganic composite oxides, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green and Malachite Green Oxalate; and various dyes such as acridine dyes, xanthene dyes, azo dyes, benzoquinone dyes, azine dyes, anthraquinone dyes, indigo dyes, thioindigo dyes, phthalocyanine dyes, Aniline Black dyes, polymethine dyes, triphenylmethane dyes, diphenylmethane dyes, thiazine dyes and thiazole dyes. These colorants may be used alone or in combination of any two or more thereof. The content of the colorant in the toner is preferably from 0.1 to 20 parts by weight and more preferably from 1 to 10 parts by weight on the basis of 100 parts by weight of the resin binder.

Examples of the charge controlling agent include chromium-based azo dyes, iron-based azo dyes, aluminum-based azo dyes and metal complexes of salicylic acid. These charge controlling agents may be used alone or in combination of any two or more thereof. The content of the charge controlling agent is preferably from 0.1 to 8 parts by weight and more preferably from 0.5 to 7 parts by weight on the basis of 100 parts by weight of the resin binder.

Examples of the releasing agent include fatty acid amides such as oleamide, erucamide, ricinolamide and stearamide; vegetable waxes such as carnauba wax, rice wax, candelilla wax, haze wax and jojoba oil; animal waxes such as beeswax; mineral and petroleum waxes such as montan wax, ozokerite, ceresin, microcrystalline wax and Fischer-Tropsch wax; polyolefin waxes; paraffin waxes; silicones; and appropriate mixtures thereof. The melting point of the releasing agent is preferably from 60 to 140° C. and more preferably from 60 to 100° C. in view of a good fusing ability and a good anti-offset property. These releasing agents may be used alone or in combination of any two or more thereof.

The content of the releasing agent in the toner is preferably from 0.5 to parts by weight, more preferably from 1 to 8 parts by weight and even more preferably from 1.5 to 7 parts by weight on the basis of 100 parts by weight of the resin binder in view of a good dispersibility in the resin binder.

[Method for Producing Toner for Electrophotography]

The method for producing the toner for electrophotography according to the present invention is not particularly limited as long as the resulting toner contains the resin binder obtained by subjecting the above aqueous polyester-containing dispersions, i.e., the aqueous dispersion containing the crystalline polyester and the aqueous dispersion containing the non-crystalline polyester, to aggregating and coalescing step.

Specific examples of the method for producing the toner of the present invention include a method of emulsion-polymerizing a radical-polymerizable monomer solution in which the resin binder is dissolved to obtain fine resin particles, and fusing the fine resin particles together in an aqueous medium (refer to JP 2001-42568A); a method of dispersing a heated resin melt composed of a raw material containing the resin binder in an aqueous medium containing no organic solvent while keeping the resin binder in a molten state and then drying the resulting dispersed particles (refer to JP 2001-235904A).

(Production of Resin Particles)

The resin binder contained in the toner for electrophotography according to the present invention is obtained by subjecting the aqueous dispersion containing the crystalline polyester and the aqueous dispersion containing the non-crystalline polyester to aggregation and coalescence steps. More specifically, the resin binder can be produced by the process including the following steps (1) to (3):

Step (1): preparing an aqueous dispersion containing a crystalline polyester produced by polycondensing an alcohol component containing 70 mol % or more of an aliphatic diol having 2 to 8 carbon atoms with a carboxylic acid component containing 50 mol % or more of terephthalic acid, and an aqueous dispersion containing a non-crystalline polyester;

Step (2): mixing the aqueous dispersion containing the crystalline polyester and the aqueous dispersion containing the non-crystalline polyester which are obtained in the step (1) with each other to subject these dispersions to aggregation, thereby obtaining an aqueous dispersion of resin particles; and Step (3): coalescing the resin particles obtained in the step (2).

The above steps (1) to (3) are described in detail.

Meanwhile, the term "aqueous" as used herein means that it may also contain a solvent such as an organic solvent, but preferably contains water in an amount of 50% by weight or more, more preferably 70% by weight or more, even more preferably 90% by weight more and further even more preferably 99% by weight or more.

In addition, the aqueous dispersion containing the polyester as used herein means the aqueous dispersion containing the crystalline polyester and/or the aqueous dispersion containing the non-crystalline polyester.

<Step (1)>

In the step (1), the aqueous dispersion containing the crystalline polyester and the aqueous dispersion containing the non-crystalline polyester are separately and individually produced.

The aqueous dispersion containing the crystalline polyester or the aqueous dispersion containing the non-crystalline polyester may be obtained by mixing the crystalline or non-crystalline polyester, an organic solvent and water, if required, together with a neutralizing agent, with each other, stirring the resulting mixture, and then removing the organic solvent from the obtained dispersion.

Preferably, the crystalline polyester or the non-crystalline polyester is first dissolved in the organic solvent, and then the resulting solution is mixed with water and, if required, the neutralizing agent.

The weight ratio between the crystalline polyester or the non-crystalline polyester and the organic solvent is controlled such that the organic solvent is preferably present in an amount of from 100 to 1000 parts by weight on the basis of 100 parts by weight of the crystalline polyester or the non-crystalline polyester. The weight ratio between the organic solvent and water is controlled such that water is preferably present in an amount of from 100 to 1000 parts by weight on the basis of 100 parts by weight of the organic solvent. The amount of the aqueous medium used is preferably from 100 to 3000 parts by weight, more preferably from 400 to 3000 parts by weight and even more preferably from 800 to 3000 parts by weight on the basis of 100 parts by weight of a total amount of the crystalline resin and the non-crystalline resin, from the viewpoint of obtaining uniform aggregated particles in the aggregating step in the below-mentioned step (2).

Examples of the organic solvent include alcohol solvents such as ethanol, isopropanol and isobutanol; ketone solvents such as acetone, methyl ethyl ketone, methyl isobutyl ketone and diethyl ketone; and ether solvents such as dibutyl ether, tetrahydrofuran and dioxane. Among these organic solvents, especially preferred are methyl ethyl ketone and methyl isobutyl ketone.

The mixture of the respective components may be stirred using an ordinary mixing and stirring apparatus such as an anchor blade. Examples of the neutralizing agent include hydroxides of alkali metals such as lithium hydroxide, sodium hydroxide and potassium hydroxide; and organic bases such as ammonia, trimethyl amine, ethyl amine, diethyl amine, triethyl amine, triethanol amine and tributyl amine.

The solid concentration of the thus obtained aqueous dispersion containing the polyester is preferably from 3 to 50%, more preferably from 5 to 30% and even more preferably from 7 to 15%.

Further, the aqueous dispersion containing the polyester may be prepared without using the organic solvent, for example, by mixing a nonionic surfactant therein. This is because when the the polyester is mixed with the nonionic surfactant, the obtained mixture exhibits a low viscosity. The decrease in viscosity of the mixture is due to decrease in apparent softening point of the polyester which is caused by compatibilization between the polyester and the nonionic surfactant. By utilizing this phenomenon, the apparent softening point of the polyester compatibilized with the nonionic surfactant can be decreased to a boiling point of water or lower. As a result, even the polyester having a melting point or a softening point of 100° C. or higher as that of the resin solely may be formed into a dispersion of the polyester in water by dropping water thereto under normal pressures.

This method may be carried out in the presence of at least water and the nonionic surfactant and is therefore applicable to resins that are insoluble in an organic solvent. In addition, the method needs neither facilities for recovering the organic solvent and maintaining working environments nor special equipments that will be required upon employing mechanical means, resulting in such an advantage that the dispersion of resin particles can be produced in an economical manner.

Examples of the nonionic surfactant include polyoxyethylene alkyl aryl ethers such as polyoxyethylene nonyl phenyl ether; polyethylene alkyl ethers such as polyoxyethylene oleyl ether and polyoxyethylene lauryl ether; polyethylene sorbitan esters such as polyethylene sorbitan monolaurate and polyoxyethylene sorbitan monostearate; polyoxyethylene fatty acid esters such as polyethylene glycol monolaurate, polyethylene glycol monostearate and polyethylene glycol monooleate; and oxyethylene/oxypropylene block copolymers. The nonionic surfactant may be used in combination with an anionic surfactant or a cationic surfactant.

The nonionic surfactant is preferably selected from those having a good compatibility with the respective polyesters used in the toner. In order to obtain a stable dispersion of the polyester, the nonionic surfactant preferably has a HLB value of 12 to 18. More preferably, two or more kinds of nonionic surfactants which are different in HLB from each other are used depending upon the kinds of polyesters used. For example, when using the resin having a high hydrophilicity, the use of at least one kind of nonionic surfactant having a HLB value of 12 to 18 may be sufficient to obtain a stable dispersion thereof. On the other hand, when using the resin having a high hydrophobicity, the nonionic surfactant having a low HLB value, for example, a HLB value of about 7 to 10, is preferably used in combination with the nonionic surfactant having a high HLB value, for example, a HLB value of 14 to 20 so as to control a weighted mean HLB value of both the nonionic surfactants to from 12 to 18. In this case, it is suggested that the nonionic surfactant having a HLB value of about 7 to 10 serves for allowing the resin to become compatilizable therewith, whereas the nonionic surfactant having a higher HLB value serves for stabilizing dispersion of the resin in water.

When the respective polyesters are formed into fine particles in water under normal pressures, the cloud point of the nonionic surfactant is preferably from 70 to 105° C. and more preferably from 80 to 105° C.

The amount of the nonionic surfactant used is preferably 5 parts by weight or more on the basis of 100 parts by weight of the crystalline polyester or the non-crystalline polyester in view of decreasing a melting point of the respective polyesters, and is preferably 80 parts by weight or less on the basis of 100 parts by weight of the crystalline polyester or the non-crystalline polyester in view of controlling the amount of the nonionic surfactant remaining in the toner. Therefore, in view of achieving both the requirements, the amount of the nonionic surfactant used is preferably in the range of from 5 to 80 parts by weight, more preferably from 10 to 70 parts by weight and even more preferably from 20 to 60 parts by weight on the basis of 100 parts by weight of the crystalline resin or the non-crystalline resin.

The average particle size of the crystalline polyester particles contained in the aqueous dispersion containing the crystalline polyester and the average particle size of the non-crystalline polyester particles contained in the aqueous dispersion containing the non-crystalline polyester are each preferably from 0.05 to 2 μm, more preferably from 0.05 to 1 μm and even more preferably from 0.05 to 0.8 μm in terms of volume-median particle diameter thereof from the viewpoint of uniformly aggregating the particles in the subsequent step (2).

<Step (2)>

In the step (2), the aqueous dispersion containing the crystalline polyester and the aqueous dispersion containing the non-crystalline polyester which are obtained in the step (1) are mixed and aggregated to obtain an aqueous dispersion of resin particles, i.e., aggregated particles. Further, in the step (2), the above additives such as a colorant, a charge controlling agent and a releasing agent may be added to the mixture of these aqueous dispersions. The preferred weight ratio between the crystalline polyester and the non-crystalline polyester obtained in the step (1) are the same as described previously.

The solid concentration of the reaction system in the aggregating step is preferably from 5 to 50% by weight, more preferably from 5 to 30% by weight and even more preferably from 5 to 20% by weight in order to allow the particles to be uniformly aggregated together.

The pH of the reaction system in the aggregating step is preferably from 2 to 10, more preferably from 2 to 9 and even more preferably from 3 to 8 in view of satisfying both a dispersion stability of the mixed solution and an aggregating property of the resin particles.

The temperature of the reaction system in the aggregating step is preferably not lower than the temperature calculated from "softening point of the resin binder minus(−) 60° C." (temperature lower by 60° C. than a softening point of the resin binder; this is similarly applied to the subsequent descriptions) but not higher than the softening point. In the present invention, since both the crystalline resin and the non-crystalline resin are used as the resin binder, the softening point of a mixed resin obtained by mixing and melting these resins is regarded as a softening point of the resin binder (this definition is similarly applied to the subsequent descriptions). In addition, when using a master batch, the softening point of a mixed resin including resins used in the master batch is regarded as a softening point of the resin binder.

In addition, the additives such as a colorant and a charge controlling agent may be previously mixed in the crystalline polyester or the non-crystalline polyester upon preparing the resin particles. Alternatively, the respective additives may be separately dispersed in a dispersing medium such as water to prepare dispersions, and the thus prepared dispersions may be mixed with the resin particles and subjected to the aggregating step. When the additives are previously mixed in the crystalline polyester or the non-crystalline polyester upon preparing the resin particles, the crystalline polyester or the non-crystalline polyester and the additives are preferably previously melt-kneaded with each other.

The melt-kneading is preferably carried out using an open roll type twin-screw kneader. The open roll type twin-screw kneader has two rolls arranged close to and parallel with each other through each of which a heating medium can be passed to impart a heating function or a cooling function thereto. Thus, since the open roll type twin-screw kneader has a melt-kneading section having an open structure and is equipped with a heating roll and a cooling roll, a kneading heat generated upon the melt-kneading can be readily released therefrom unlike the conventional twin-screw kneaders.

In the aggregating step, in order to effectively carry out the aggregation, an aggregating agent may be added. As the organic aggregating agent, a cationic surfactant in the form of a quaternary salt, polyethyleneimine, or the like may be used, and as the inorganic aggregating agent, an inorganic metal salt, a divalent or higher polyvalent metal complex or the like may be used. The inorganic metal salt includes, for example, metal salts such as sodium sulfate, sodium chloride, calcium chloride, calcium nitrate, barium chloride, magnesium chloride, zinc chloride, aluminum chloride and aluminum sulfate; and inorganic metal salt polymers such as poly(aluminum chloride), poly(aluminum hydroxide), and poly(calcium sulfide).

The amount of the aggregating agent used is preferably 30 parts by weight or less, more preferably 20 parts by weight or less and even more preferably 10 parts by weight or less on the basis of 100 parts by weight of the resin binder, in view of a good environmental resistance of the resultant toner.

The aggregating agent is preferably added in the form of an aqueous solution prepared by dissolving the agent in an aqueous medium, and the resultant mixture is preferably sufficiently stirred during and after addition of the aggregating agent.

In the step (2), the mixture containing the aqueous dispersion containing the crystalline polyester and the aqueous dispersion containing the non-crystalline polyester, if required, together with various additives is preferably subjected to dispersing treatment at a temperature lower than the softening point of the resin binder from the viewpoint of obtaining a uniform dispersion. The dispersing treatment is carried out at a temperature preferably lower than the softening point of the resin binder, more preferably not higher than the temperature calculated from "softening point of the resin binder minus(−) 50° C.", to thereby prepare a uniform resin dispersion. The lower limit of the temperature used for the dispersing treatment is preferably higher than 0° C. and more preferably 10° C. or higher from the viewpoint of a good fluidity of the medium and saving of energy required for production of the resin emulsion. In the present invention, since both the crystalline polyester and the non-crystalline polyester are used as the resin binder, the softening point of the mixed resin prepared by mixing and melting both the resins at a given mixing ratio is regarded as the softening point of the resin binder (this definition is similarly applied to the subsequent descriptions). Also, when using a master batch, the softening point of a mixture of its components including resins used therein is regarded as the softening point of the resin binder.

More specifically, particles of an acid group-containing resin such as, for example, polyesters, may be stirred and dispersed together with the additives such as a colorant in a basic aqueous medium containing a surfactant at a temperature lower than the softening point of the resin particles, for example, at a temperature of from about 10 to about 50° C. by an ordinary method, thereby obtaining the uniform resin dispersion.

The dispersing method may be conducted using a high-speed mixer or stirrer such as "Ultra Disper" (tradename: available from Asada Tekko Co., Ltd.), "Ebara Milder" (tradename: available from Ebara Seisakusho Co., Ltd.) and "TK Homomixer" (tradename: available from Primix Co., Ltd.); a homo-valve-type high-pressure homogenizer such as typically "High-Pressure Homogenizer" (tradename: available from Izumi Food Machinery Co., Ltd.) and "Mini-Labo 8.3H Model" (tradename: available from Rannie Corp.); and a chamber-type high-pressure homogenizer such as "Micro Fluidizer" (tradename: available from Microfluidics Inc.) and "Nanomizer" (tradename: available from Nanomizer Co., Ltd.).

The total amount of the aqueous medium used in the step (2) is preferably from 100 to 3000 parts by weight, more preferably from 400 to 3000 parts by weight and even more preferably from 800 to 3000 parts by weight on the basis of 100 parts by weight of a total amount of the crystalline polyester and the non-crystalline polyester from the viewpoint of obtaining uniform aggregated particles in the subsequent step.

The average particle size of the resin particles is preferably from 1 to 10 μm, more preferably from 2 to 8 μm and even more preferably from 3 to 7 μm in terms of volume-median particle diameter thereof from the viewpoint of uniformly coalescing the particles in the subsequent step and thereby producing toner particles.

In the present invention, the volume-median particle diameter of the respective particles such as resin particles may be measured by a laser diffraction type particle size measuring apparatus, etc.

<Step (3)>

In the step (3), the resin particles thus obtained in the step (2) are subjected to coalescence.

Specifically, in the step (3) as the coalescing step, the resin particles thus obtained in the above aggregating step, i.e., the aggregated particles containing the resin binder, are heated and unified.

The temperature of the reaction system in the coalescing step is preferably not lower than the temperature calculated from "softening point of the resin binder −(minus) 30° C." but not higher than the temperature calculated from the "softening point of the resin binder +(plus) 10° C.", more preferably not lower than the temperature calculated from the "softening point of the resin binder −(minus) 25° C." but not higher than the temperature calculated from the "softening point of the resin binder +(plus) 10° C.", and even more preferably not lower than the temperature calculated from the "softening point of the resin binder −(minus) 20° C." but not higher than the temperature calculated from the "softening point of the resin binder +(plus) 10° C." in view of controlling a particle size, a particle size distribution and a shape of the toner as aimed as well as fusibility of the particles. In addition, the stirring rate is preferably such a rate at which the aggregated particles are not precipitated.

(Production of Core-Shell Particles)

In the present invention, there is also preferably used a toner for electrophotography which contains, as a resin binder, core-shell particles each having a core portion obtained by subjecting an aqueous dispersion of a crystalline polyester and an aqueous dispersion of a non-crystalline polyester to aggregation, and a shell portion obtained from a non-crystalline polyester.

The toner for electrophotography which contains the core-shell particles can be produced by such a process in which a step of mixing the aqueous dispersion of the resin particles obtained in the step (2) with the aqueous dispersion containing the non-crystalline polyester to subject these dispersions to aggregation, is carried out prior to the above step (3).

That is, the production process includes the following steps (1') to (3').

Step (1'): mixing an aqueous dispersion containing a crystalline polyester produced by polycondensing an alcohol component containing 70 mol % or more of an aliphatic diol having 2 to 8 carbon atoms with a carboxylic acid component containing 50 mol % or more of terephthalic acid, with an aqueous dispersion containing a non-crystalline polyester to subject these dispersions to aggregation, thereby obtaining an aqueous dispersion of resin particles A;

Step (2'): mixing the aqueous dispersion of resin particles A obtained in the step (1') with an aqueous dispersion containing a non-crystalline polyester to subject these dispersions to aggregation, thereby obtaining an aqueous dispersion of resin particles B; and Step (3'): coalescing the resin particles B obtained in the step (2').

By conducting the above process, it is possible to obtain the core-shell particles each having a shell portion made of the non-crystalline polyester and a core portion made of a polyester containing the non-crystalline polyester and the crystalline polyester. Meanwhile, the shell portion may also contain other resins unless the inclusion thereof adversely affects the aimed effects of the present invention. When the non-crystalline polyester is used in the shell portion, the resulting toner is further enhanced in fusing ability and also is excellent in pressure storage stability. The content of the non-crystalline polyester in the shell portion is preferably 50% by mass or more, more preferably 80% by mass or more, even more preferably 90% by mass or more and further even more preferably substantially 100% by mass.

The step (1') is identical to the above steps (1) and (2). The average particle size of the resin particles A obtained in the step (1') is preferably from 0.8 to 9.8 μm, more preferably from 1.8 to 7.8 μm and even more preferably from 2.8 to 6.8 in terms of a volume-median particle diameter thereof from the viewpoint of forming a uniform shell portion in the subsequent step.

In the step (2'), the resin particles A obtained in the step (1') and the aqueous dispersion containing the non-crystalline polyester are mixed with each other to subject them to aggregation, thereby obtaining the resin particles B. The aqueous dispersion containing the non-crystalline polyester to be mixed may be the same as or different from that used in the core portion. From the viewpoint of obtaining uniform core-shell particles, it is preferred that the non-crystalline polyester used have the same volume-median particle diameter as described above.

The amount of the non-crystalline polyester to be mixed is preferably from 10 to 300 parts by weight and more preferably from 20 to 100 parts by weight on the basis of 100 parts by weight of the crystalline polyester in the resin particles A obtained in the step (1'). In addition, the amount of the non-crystalline polyester to be mixed is preferably from 5 to 100 parts by weight and more preferably from 10 to 80 parts by weight on the basis of 100 parts by weight of the non-crystalline polyester in the resin particles A obtained in the step (1').

The average particle size of the resin particles B obtained in the step (2') is preferably from 1 to 10 μm, more preferably from 2 to 8 μm and even more preferably from 3 to 7 μm in terms of volume-median particle diameter thereof from the viewpoint of uniformly coalescing the particles in the subsequent step (3') and thereby producing toner particles.

The aggregation conditions are the same as those of the above step (2). Also, the step (3') is the same as the above step (3).

The weight ratio between the crystalline polyester and the non-crystalline polyester in the core-shell particles is the same as described previously.

(Production of Toner)

The unified particles obtained in the step (3) or (3') may be appropriately subjected to liquid-solid separation step such as filtration, washing step and drying step according to requirements, thereby obtaining the toner for electrophotography according to the present invention.

In the washing step, an acid is preferably used to remove metal ions on the surface of the respective toner particles for the purpose of ensuring sufficient chargeability and reliability as a toner. Also, in the washing step, the nonionic surfactant previously added is preferably completely removed from the toner. For this purpose, the washing step is preferably carried out in an aqueous solution at a temperature not higher than the cloud point of the nonionic surfactant. The washing step is preferably repeated plural times.

In addition, the drying step may be carried out by any optional methods such as vibration-type fluidizing/drying method, spray-drying method, freeze-drying method or flash jet method. The water content in the toner after being dried is adjusted to preferably 1.5% by weight or less and more preferably 1.0% by weight or less in view of a good chargeability of the toner.

The volume-median particle diameter of the toner is preferably from 1 to 10 μm, more preferably from 2 to 8 μm and even more preferably from 3 to 7 μm in view of high image quality and high productivity of the toner.

Also, the toner preferably has a softening point of from 80 to 160° C., more preferably from 80 to 150° C. and even more preferably from 90 to 140° C. in view of low-temperature fusing ability. In addition, the toner preferably has a glass transition point of from 45 to 80° C. and more preferably from 50 to 70° C. from the same viewpoint as described above.

In the toner obtained by the present invention, an auxiliary agent such as a fluidizing agent may be applied as an external additive to the surface of the toner particles. As the external additive, there may be used known fine particles, e.g., inorganic fine particles such as fine silica particles whose surface is hydrophobilized, fine titanium oxide particles, fine alumina particles, fine cerium oxide particles and carbon blacks as well as fine particles of polymers such as polycarbonates, poly(methyl methacrylate) and silicon resins.

The number-average particle size of the external additive is preferably from 4 to 200 nm and more preferably from 8 to 30 nm. The number-average particle size of the external additive may be measured using a scanning type electron microscope or a transmission type electron microscope.

The amount of the external additive, if added to the toner, is preferably from 0.8 to 5.0 parts by weight, more preferably from 1.0 to 5.0 parts by weight and even more preferably from 1.5 to 3.5 parts by weight on the basis of 100 parts by weight of the toner before being treated with the external additive, from the viewpoints of a good fusing ability and a good pressure storage stability of the resulting toner. When a hydrophobic silica is used as the external additive, the hydrophobic silica is preferably added in an amount of from 0.8 to 3.5 parts by weight and preferably from 1.0 to 3.0 parts by weight on the basis of 100 parts by weight of the toner before being treated with the external additive, in order to attain desired effects.

The toners for electrophotography according to the present invention can be used as not only an one-component type developer but also a two-component type developer in the form of a mixture with a carrier.

EXAMPLES

[Measurements of Polyesters and Resin Particles]

The measurements for softening point, glass transition temperature, endothermic maximum peak temperature, melting point, acid value and weight-average molecular weight of the polyesters obtained in the respective Production Examples and the measurement using a differential scanning colorimeter (DSC) as well as the measurement for volume-median particle diameter ($D_{50}$) of the respective particles were carried out by the following methods.

(Softening Point)

The softening point refers to a temperature at which a half the amount of a sample flowed out when plotting a downward movement of a plunger relative to temperature, as measured by using a flow tester "CFT500D" available from Shimadzu Seisakusho Co., Ltd., in which 1 g of the sample was extruded through a nozzle having a die pore size of 1 mm and a length of 1 mm while heating the sample at a temperature rise rate of 6° C./min and applying a load of 1.96 MPa thereto with the plunger.

(Glass Transition Temperature)

Using a differential scanning calorimeter "Q-100" available from T.A. Instruments, Japan, Inc., 0.01 to 0.02 g of a sample weighed on an aluminum pan was heated to 200° C., cooled from 200° C. to 0° C. at a temperature drop rate of 10° C./min and further heated at a temperature rise rate of 10° C./min to prepare an endothermic curve. The glass transition temperature of the sample was determined from the endothermic curve, as the temperature at which an extension of a base line below the endothermic maximum peak temperature intersects a tangential line having a maximum inclination in a region from a raise-up portion to an apex of the peak in the curve.

(Melting Point)

Using a differential scanning calorimeter "Q-100" available from T.A. Instruments, Japan, Inc., a sample was cooled from room temperature to 0° C. at a temperature drop rate of 10° C./min, allowed to stand at 0° C. for 1 min, and then heated up to 150° C. at a temperature rise rate of 10° C./min to measure an endothermic curve thereof. The temperature of the peak present on the highest temperature side among the endothermic peaks observed in the curve was determined as the endothermic maximum peak temperature. If the difference between the maximum peak temperature and the softening point fell within 20° C., the maximum peak temperature was determined as the melting point.

(Acid Value)

Determined according to JIS K0070. However, with respect to only a solvent used upon the measurement, the mixed solvent of ethanol and ether as prescribed in JIS K0070 was changed to a mixed solvent containing acetone and toluene at a volume ratio of 1:1.

(Weight-Average Molecular Weight)

(1) Preparation of Sample Solution

The polyester was dissolved in THF to prepare a solution having a concentration of 0.04 g/10 mL. The resultant solution was then filtered through a 0.45 μm-mesh fluororesin filter ("DISMIC-25JP" commercially available from Advantech Co., Ltd.) to remove insoluble components therefrom, thereby obtaining a sample solution.

(2) Determination of Molecular Weight

Using the below-mentioned analyzer, THF was allowed to flow therethrough at a rate of 1 mL/min, and the column was stabilized in a thermostat at 40° C. One-hundred microliters of the sample solution was injected to the column to conduct the measurement. The molecular weight of the sample was calculated on the basis of a calibration curve previously prepared. The calibration curve for determination of the molecular weight was prepared by using several kinds of monodisperse polystyrenes as standard samples.

Analyzer: HLC-8220 GPC (commercially available from Tosoh Corporation)

Column: $GMH_{XL}$+$G3000H_{XL}$ (commercially available from Tosoh Corporation)

(Measurement Using Differential Scanning Colorimeter (DSC))

Using a differential scanning calorimeter "Q-100" available from T.A. Instruments, Japan, Inc., a sample was cooled from room temperature to 0° C. at a temperature drop rate of 10° C./min, and then allowed to stand at 0° C. for 1 min, and then heated from 0° C. to 180° C. at a temperature rise rate of 10° C./min to measure thermal properties thereof (1st RUN). After allowing the sample to stand at 180° C. for 5 min, the sample was cooled from 180 to 0° C. at a temperature drop rate of 10° C./min to measure the thermal properties (2nd RUN). Further, after allowing the sample to stand at 0° C. for 5 min, the sample was heated again from 0 to 180° C. at a temperature rise rate of 10° C./min to measure the thermal properties (3rd RUN). By conducting the above thermal process, the ratios "X/Y" and "Z/X" were determined.

X: Area of an endothermic peak observed in the 1st RUN;

Y: Area of an exothermic peak observed in the 2nd RUN; and

Z: Area of an exothermic peak observed in the 3rd RUN.

(Volume-Median Particle Diameter ($D_{50}$))

Using a laser diffraction particle size analyzer ("SALD-2000J" commercially available from Shimadzu Corporation), a measuring cell was charged with distilled water, and a volume-median particle diameter ($D_{50}$) was measured at such a concentration of the dispersion that an absorbance thereof fell within a proper range.

[Production Examples of Crystalline Polyesters (Resins A to O)]

(Production of Resins A, B and D to O)

A 10 L four-necked flask equipped with a nitrogen inlet tube, a dehydration tube, a stirrer and a thermocouple was charged with the raw materials shown in Table 1 and 40 g of tin octylate. The contents of the flask were reacted with each other for 4 h at 180° C. Thereafter, the obtained reaction mixture was heated to 210° C. at a rate of 10° C./h, held at 210° C. for 8 h, and then reacted under a pressure of 8.3 kPa for 1 h.

The results of measurements for softening point, endothermic maximum peak temperature, melting point, acid value and weight-average molecular weight of the thus obtained resins and the results of measurements of the resins using a differential scanning calorimeter (DSC) as well as the results of calculations of "softening point/endothermic maximum peak temperature", "X/Y" and "Z/X" are shown in Table 1.

(Production of Resin C)

A 10 L four-necked flask equipped with a nitrogen inlet tube, a dehydration tube, a stirrer and a thermocouple was charged with the raw materials except for trimellitic acid as shown in Table 1 and 40 g of tin octylate. The contents of the flask were reacted with each other for 4 h at 180° C. Thereafter, the obtained reaction mixture was heated to 210° C. at a rate of 10° C./h, and then held at 210° C. for 8 h. After adding trimellitic acid to the reaction solution, the resulting mixture was reacted for 3 h and further reacted under a pressure of 8.3 kPa for 1 h.

The results of measurements for softening point, endothermic maximum peak temperature, melting point, acid value and weight-average molecular weight of each of the thus obtained resins A to N and the results of measurements of the resins using a differential scanning calorimeter (DSC) as well as the results of calculations of "softening point/endothermic maximum peak temperature", "X/Y" and "Z/X" are shown in Table 1.

TABLE 1

| | Resins | | | | |
|---|---|---|---|---|---|
| Crystalline polyesters | A | B | C | D | E |
| Raw materials | | | | | |
| Alcohol component (g) (mol %) | | | | | |
| Ethylene glycol | — | — | — | — | — |
| Neopentyl glycol | — | 967 (30) | — | — | — |
| 1,5-Pentanediol | 1290 (40) | — | 645 (20) | 1612 (50) | 967 (30) |
| KALCOL 6870 | — | — | — | — | — |
| 1,6-Hexanediol | 2195 (60) | 2561 (70) | 2926 (80) | 1829 (50) | 2561 (70) |
| 1,9-Nonanediol | — | — | — | — | — |
| Carboxylic acid component (g) (mol %) | | | | | |
| Terephthalic acid | 4889 (95) | 4889 (95) | 4631 (90) | 4889 (95) | 4889 (95) |
| Isophthalic acid | — | — | — | — | — |
| Sebacic acid | — | — | — | — | — |
| Trimellitic acid | — | — | 595 (10) | — | — |
| Total mol % of terephthalic acid and 1,6-hexanediol in raw materials | 79.5 | 84.6 | 85 | 74.3 | 84.6 |
| Measurement results | | | | | |
| Softening point (° C.) | 89.6 | 90.8 | 86.4 | 68.8 | 100.4 |
| Endothermic maximum peak temperature, melting point (° C.) | 95.4 | 97.2 | 93.9 | 76.1 | 108.7 |
| Softening point/endothermic maximum peak temperature | 0.94 | 0.93 | 0.92 | 0.90 | 0.92 |
| Acid value | 18.4 | 17.3 | 21.6 | 15.2 | 21.2 |
| Weight-average molecular weight | 75000 | 79000 | 84000 | 114000 | 64000 |
| X/Y | 0.02 | 0.01 | 0.03 | 0.01 | 0.15 |
| Z/X | 0.89 | 0.86 | 0.79 | 0.64 | 0.65 |

| | Resins | | | | |
|---|---|---|---|---|---|
| Crystalline polyesters | F | G | H | I | J |
| Raw materials | | | | | |
| Alcohol component (g) (mol %) | | | | | |
| Ethylene glycol | — | — | 1733 (90) | — | — |
| Neopentyl glycol | — | — | — | — | — |
| 1,5-Pentanediol | 806 (25) | 484 (15) | 322 (10) | — | — |
| KALCOL 6870 | — | — | — | — | — |
| 1,6-Hexanediol | 2744 (75) | 3109 (85) | — | — | 2950 (100) |
| 1,9-Nonanediol | — | — | — | 4100 (100) | — |
| Carboxylic acid component (g) (mol %) | | | | | |
| Terephthalic acid | 4889 (95) | 4889 (95) | — | 4150 (100) | — |
| Isophthalic acid | — | — | — | — | — |
| Sebacic acid | — | — | 6262 (100) | — | 5058 (100) |
| Trimellitic acid | — | — | — | — | — |

TABLE 1-continued

| | | | | | |
|---|---|---|---|---|---|
| Total mol % of terephthalic acid and 1,6-hexanediol in raw materials | 87 | 92.3 | 0 | 50 | 50 |
| Measurement results | | | | | |
| Softening point (° C.) | 111.5 | 119.3 | 91.7 | 92.3 | 67.7 |
| Endothermic maximum peak temperature, melting point (° C.) | 117.8 | 126.2 | 98.3 | 96.6 | 70.9 |
| Softening point/endothermic maximum peak temperature | 0.95 | 0.95 | 0.93 | 0.96 | 0.95 |
| Acid value | 24.6 | 18.7 | 22.2 | 20.9 | 18.3 |
| Weight-average molecular weight | 58000 | 74000 | 83000 | 94000 | 92000 |
| X/Y | 0.7 | 0.75 | 0.63 | 0.72 | 0.82 |
| Z/X | 0.23 | 0.04 | 0.02 | 0.03 | 0.02 |

| | Resins | | | | |
|---|---|---|---|---|---|
| Crystalline polyesters | K | L | M | N | O |
| Raw materials | | | | | |
| Alcohol component (g) (mol %) | | | | | |
| Ethylene glycol | — | — | — | — | — |
| Neopentyl glycol | — | — | — | — | — |
| 1,5-Pentanediol | 780 (30) | 874 (30) | — | — | 998 (32) |
| KALCOL 6870 | — | — | — | — | 736 (10) |
| 1,6-Hexanediol | 2065 (70) | 2313 (70) | 3540 (100) | 3068 (100) | 2230 (63) |
| 1,9-Nonanediol | — | — | — | — | — |
| Carboxylic acid component (g) (mol %) | | | | | |
| Terephthalic acid | — | — | 2988 (60) | 1295 (30) | 4731 (95) |
| Isophthalic acid | — | 4416 (95) | — | — | — |
| Sebacic acid | 5058 (100) | — | 1512 (35) | 3682 (70) | — |
| Trimellitic acid | — | — | — | — | — |
| Total mol % of terephthalic acid and 1,6-hexanediol in raw materials | 35 | 35.9 | 82.1 | 65 | 79 |
| Measurement results | | | | | |
| Softening point (° C.) | 56.5 | 107.5 | 93.5 | 58.6 | 91.3 |
| Endothermic maximum peak temperature, melting point (° C.) | 60.4 | 114.2 | 97.5 | 62.4 | 96.6 |
| Softening point/endothermic maximum peak temperature | 0.94 | 0.94 | 0.96 | 0.94 | 0.95 |
| Acid value | 19.2 | 17.4 | 17.8 | 18.9 | 17.9 |
| Weight-average molecular weight | 88000 | 62000 | 81000 | 87000 | 76000 |
| X/Y | 0.76 | 0.11 | 0.14 | 0.47 | 0.04 |
| Z/X | 0.08 | 0.53 | 0.72 | 0.31 | 0.87 |

Note

X: Area of endothermic peak observed in 1st RUN

Y: Area of exothermic peak observed in 2nd RUN

Z: Area of exothermic peak observed in 3rd RUN

The numerals within the parentheses "( )" each indicate a molar ratio based on moles of whole alcohol components as 100, but in the case of resin O, the numerals each indicate a molar ratio based on moles of whole alcohol components as 105

KALCOL 6870: Cetyl alcohol (available from Kao Corp.)

[Production Examples of Non-Crystalline Polyesters (Resins AA to AC)]

(Production of Resin AA)

A 10 L four-necked flask equipped with a nitrogen inlet tube, a dehydration tube, a stirrer and a thermocouple was charged with the raw materials except for trimellitic anhydride as shown in Table 2 and 40 g of tin octylate. The contents of the flask were reacted with each other for 8 h at 230° C., and then reacted under a pressure of 8.3 kPa for 1 h. After adding trimellitic anhydride to the reaction solution at 210° C., the resulting mixture was further reacted until reaching a softening point of the obtained resin.

(Production of Resin AB)

A 10 L four-necked flask equipped with a nitrogen inlet tube, a dehydration tube, a stirrer and a thermocouple was charged with the raw materials except for trimellitic anhydride and fumaric acid as shown in Table 2 and 40 g of tin octylate. The contents of the flask were reacted with each other for 8 h at 230° C., and then reacted under a pressure of 8.3 kPa for 1 h. After adding fumaric acid, 3 g of tert-butyl catechol and trimellitic anhydride to the reaction solution at 180° C., the resulting mixture was heated to 210° C. over 4 h, and then reacted at 210° C. until reaching a softening point of the obtained resin.

(Production of Resin AC)

A 5 L four-necked flask equipped with a dehydration tube connected to a rectifier column through which a 100° C. hot water was circulated, a nitrogen inlet tube, a stirrer and a thermocouple was charged with the raw materials except for trimellitic anhydride as shown in Table 2, 40 g of tin octylate and 2 g of gallic acid. The contents of the flask were reacted with each other while heating from 180 to 230° C. over 8 h, and then reacted under a pressure of 8.3 kPa for 1 h. After further adding trimellitic anhydride to the reaction solution, the obtained mixture was reacted at 220° C. under a pressure of 40 kPa until reaching a softening point of the obtained resin.

The results of measurements for softening point, acid value, weight-average molecular weight, endothermic maximum peak temperature and glass transition temperature of each of the thus obtained resins AA to AC are shown in Table 2.

TABLE 2

| | Resins | | |
|---|---|---|---|
| Non-crystalline polyesters | AA | AB | AC |
| Raw materials | | | |
| Alcohol component (g) (mol %) | | | |
| BPA-PO | 3675 (70) | 3676 (70) | — |
| BPA-EO | 1463 (30) | 1464 (30) | — |
| 1,2-Propanediol | — | — | 2432 (100) |
| Carboxylic acid component (g) (mol %) | | | |
| Terephthalic acid | 1544 (62) | 266 (10) | 3187 (60) |
| Dodecenylsuccinic anhydride | 1246 (31) | 858 (20) | 1286 (15) |
| Fumaric acid | — | 928 (50) | — |
| Trimellitic anhydride | 346 (12) | 461 (15) | 1229 (20) |
| Measurement results | | | |
| Softening point (° C.) | 113.6 | 115.3 | 114.3 |
| Acid value | 21.5 | 20.7 | 18.7 |
| Weight-average molecular weight | 149000 | 176000 | 162000 |
| Endothermic maximum peak temperature (° C.) | 60.1 | 58.2 | 59.4 |
| Glass transition temperature (° C.) | 57.7 | 56.4 | 57.1 |

Note

BPA-PO: Polyoxypropylene adduct of bisphenol A

BPA-EO: Polyoxyethylene adduct of bisphenol A

The numerals within the parentheses "( )" each indicate a molar ratio based on moles of whole alcohol components as 100.

[Production Examples of Dispersions]

(Aqueous Dispersions Containing Resins A to N or AA to AC)

A 5 L container equipped with a stirrer, a reflux condenser, a dropping funnel, a thermometer and a nitrogen inlet tube was charged with 600 g of methyl ethyl ketone, and then 200 g of each of the resins A to O or AA to AC produced in the above respective Production Examples was added to the container at 60° C. and dissolved in the solvent. The thus obtained solution was mixed and neutralized with 10 g of triethyl amine, and successively mixed with 2000 g of ion-exchanged water. The resulting mixture was distilled under reduced pressure at a temperature of 50° C. or lower while stirring at 250 r/min to remove methyl ethyl ketone therefrom, thereby obtaining a self-dispersible aqueous polyester dispersion (resin content: 9.6% by weight (in terms of solid content)). The polyester particles contained in the thus obtained polyester dispersion had a volume-median particle diameter of 0.3 μm.

The polyester dispersions produced by using the respective polyesters are hereinafter referred to as polyester dispersions A to O and AA to AC, respectively.

(Other Dispersions)

<Colorant Dispersion>

Fifty grams of copper phthalocyanine (type number: "ECB-301" available from Dainichiseika Color and Chemicals Mfg. Co., Ltd.), 5 g of a nonionic surfactant ("EMULGEN (registered trademark) 150" available from Kao Corp.) and 200 g of ion-exchanged water were mixed with each other to dissolve the copper phthalocyanine. The resultant solution was dispersed for 10 mm using a homogenizer, thereby obtaining a colorant dispersion. The colorant particles contained in the thus obtained colorant dispersion had a volume-median particle diameter of 120 nm.

<Wax (releasing agent) Dispersion>

Fifty grams of a paraffin wax ("HNP0190" available from Nippon Seiro Co., Ltd.; melting point: 85° C.), 5 g of a cationic surfactant ("SANISOL (registered trademark) B50" available from Kao Corp.) and 200 g of ion-exchanged water were heated to 95° C. and stirred using a homogenizer to disperse the paraffin wax therein, and then the resulting mixture was subjected to dispersing treatment using a pressure injection type homogenizer, thereby obtaining a wax (releasing agent) dispersion. The paraffin wax particles contained in the thus obtained wax dispersion had a volume-median particle diameter of 550 nm.

<Charge Controlling Agent Dispersion>

Fifty grams of a charge controlling agent ("BONTRONE E-84" available from Orient Chemical Industries, Ltd.), 5 g of a nonionic surfactant ("EMULGEN (registered trademark) 150" available from Kao Corp.) and 200 g of ion-exchanged water were mixed with each other. The resultant mixture was dispersed with glass beads using a sand grinder for 10 min to obtain a charge controlling agent dispersion. The charge controlling agent particles contained in the thus obtained charge controlling agent dispersion had a volume-median particle diameter of 500 nm.

[Measurement and Evaluation of Toner]

The measurement for a volume-median particle diameter ($D_{50}$) of the respective toners obtained in Examples and Comparative Examples as well as the evaluation for fusing ability and pressure storage stability thereof were performed as follows. Meanwhile, the measurement for softening point and glass transition temperature of the respective toners was conducted by the same method as used in the measurement of the above polyester resin.

(Volume-Median Particle Diameter ($D_{50}$))

(1) Preparation of Dispersion

Ten milligrams of a sample to be measured was added to 5 mL of a dispersing solution [a 5% by weight aqueous solution of "EMULGEN (registered trademark) 109P" (available from Kao Corp.; polyoxyethylene lauryl ether, HLB: 13.6)], and dispersed using an ultrasonic disperser for 1 min. Thereafter, 25 mL of an electrolyte "Isotone II" (available from Beckman Coulter, Inc.) was added to the obtained mixture, and the mixture was further dispersed using the ultrasonic disperser for 1 min to obtain a dispersion.

(2) Measuring Apparatus: "Coulter Multisizer II" (available from Beckman Coulter Co., Ltd.)

Aperture Diameter: 100 μm;

Measuring particle size range: 2 to 40 μm;

Analyzing Software: "Coulter Multisizer AccuComp Ver. 1.19" (available from Beckman Coulter Co., Ltd.)

(3) Measuring Conditions

One-hundred milliliters of the electrolyte and the dispersion were charged into a beaker, and particle sizes of 30000 particles in the dispersion were measured at such a concentration of the dispersion at which the measurement for the 30000 particles were completed within 20 seconds, to determine a volume-median particle diameter ($D_{50}$) thereof.

(Fusing Ability)

The toner was loaded into a copying machine "AR-505" available from Sharp Corp., to obtain an unfixed image (printed area: 2 cm×12 cm; amount of the toner adhered: 0.5 mg/cm$^2$).

The thus obtained unfixed image was placed in a thermostat controlled to a specific temperature for 60 seconds and then subjected to measurement for fixing strength thereof The temperature of the thermostat was raised from 70° C. at the intervals of 5° C. to examine the fixing strength. Meanwhile, "Copy Bond SF-70NA" (available from Sharp Corp.; 75 g/m$^2$) was used as a fixing paper.

The measurement for the fixing strength was conducted as follows. That is, an adhesive cellophane tape "UNICEF CELLOPHANE" (available from Mitsubishi Pencil Co., Ltd.; width: 18 mm; JIS Z-1522) was attached onto the fixed image, and passed through a fixing roll set to 30° C. Then, the tape was peeled off from the fixed image to measure an optical reflection density thereof before and after peeling off the tape, using a reflection-type densitometer "RD-915" available from Gretag Macbeth Corp. From the thus measured values, a minimum fixing temperature of the toner was determined as the temperature of the thermostat at which a ratio in optical reflection density of the fixed image between before and after peeling off the tape (after peeling/before peeling) first exceeded 90%. The minimum fixing temperature was examined to evaluate a low-temperature fusing ability of the toner according to the following evaluation criteria. The lower the minimum fixing temperature, the more excellent the low-temperature fusing ability of the toner.

a: Minimum fixing temperature was lower than 80° C.;

b: Minimum fixing temperature was not lower than 80° C. but lower than 90° C.;

c: Minimum fixing temperature was not lower than 90° C. but lower than 95° C.; and d: Minimum fixing temperature was not lower than 95° C. but lower than 100° C.; and e: Minimum fixing temperature was not lower than 100° C.

(Pressure Storage Stability)

Ten grams of the respective toners were charged into an cylindrical container having a radius of 12 mm. Then, the toner thus filled in the container was loaded from above with a weight of 100 g, and allowed to stand under environmental conditions of a temperature of 50° C. and a humidity of 60% for 24 h. Three sieves including a sieve A (mesh size: 250 μm), a sieve B (mesh size: 150 μm) and a sieve C (mesh size: 75 μm) were set to a powder tester (available from Hosokawa Micron Co., Ltd.) in an overlapped state in this order from above, and 10 g of the toner was placed on the uppermost sieve A and vibrated for 60 seconds.

The toner was evaluated for pressure storage stability on the basis of the value calculated from the following formula according to the following evaluation criteria. The higher value is more preferable.

$$100-\{[(\text{Weight (g) of toner remaining on the sieve A})+(\text{Weight (g) of toner remaining on the sieve B})\times 0.6+(\text{Weight (g) of toner remaining on the sieve C})\times 0.2]/10\ (\text{g})\}\times 100$$

a: From 90 to 100;

b: Not less than 80 but less than 90;

c: Not less than 60 but less than 80; and d: Less than 60.

Examples 1 to 13 and Comparative Examples 1 to 7

Production of Toners

Fifty grams of the mixed dispersion prepared by formulating the respective polyester dispersions obtained in the above Production Examples at proportions shown in Table 3, 20 g of the colorant dispersion, 15 g of the wax dispersion, 7 g of the charge controlling agent dispersion and 1.5 g of a cationic surfactant ("SANISOL (registered trademark) B50" available from Kao Corp.) were charged into a round stainless steel flask, and mixed and dispersed therein using a homogenizer. The contents of the flask were heated to 48° C. in a heating oil bath while stirring, and further held at 48° C. for 1 h. As a result, it was confirmed that aggregated particles having a weight-average particle size of 5.1 μm were produced in the dispersion.

After adding 3 g of an anionic surfactant ("PELEX SS-L" available from Kao Corp.) to the dispersion containing the aggregated particles, a reflux tube was fitted to the stainless steel flask, and the contents of the flask were heated to 80° C. at a rate of 0.1° C./min while continuously stirring and then held at 80° C. for 5 h to unify and fuse the aggregated particles. Thereafter, the obtained dispersion was cooled and filtered to separate the resulting fused particles therefrom. The thus obtained fused particles were fully washed with ion-exchanged water and then dried, thereby obtaining colored resin particles. The thus obtained colored resin particles had a volume-median particle diameter (D50) of 5.0 μm.

Next, 1.0 part by weight of a hydrophobic silica ("TS530" available from Wacker Chemie Inc.; number-average particle size: 8 nm) was mixed with and externally added to 100 parts by weight of the thus obtained colored resin particles using a Henschel mixer to obtain a cyan toner. The resulting cyan toner had a volume-median particle diameter ($D_{50}$) of 5.0 μm.

The results of measurements for softening point and glass transition temperature of the resulting cyan toner as well as the results of evaluation for fusing ability and pressure storage stability thereof are shown in Table 3.

TABLE 3

| | Examples | | | | | |
|---|---|---|---|---|---|---|
| | 1 | 2 | 3 | 4 | 5 | 6 |
| Proportions of polyester dispersions (g) | A/AA = 150/350 | A/AA = 100/400 | A/AA = 200/300 | B/AA = 150/350 | C/AA = 150/350 | D/AA = 150/350 |
| | Measurement results | | | | | |
| Softening point (° C.) | 107.3 | 110.5 | 106.6 | 107 | 107.7 | 105.7 |
| Glass transition temperature (° C.) | 58.6 | 58.2 | 58.9 | 58.5 | 58.5 | 52.5 |
| Fusing ability | a | b | a | a | a | b |
| Pressure storage stability | a | a | b | b | b | d |

TABLE 3-continued

| | Examples | | | | | | |
|---|---|---|---|---|---|---|---|
| | 7 | 8 | 9 | 10 | 11 | 12 | 13 |
| Proportions of polyester dispersions (g) | E/AA = 150/350 | F/AA = 150/350 | G/AA = 150/350 | A/AB = 150/350 | A/AC = 150/350 | M/AA = 150/350 | O/AA = 150/350 |
| | Measurement results | | | | | | |
| Softening point (° C.) | 108.4 | 110.7 | 113.5 | 111.3 | 109.6 | 109.5 | 108.3 |
| Glass transition temperature (° C.) | 59 | 59.4 | 59.6 | 57 | 57.4 | 57.9 | 58.3 |
| Fusing ability | b | c | d | c | b | a | a |
| Pressure storage stability | b | b | d | a | a | b | a |

| | Comparative Examples | | | | | | |
|---|---|---|---|---|---|---|---|
| | 1 | 2 | 3 | 4 | 5 | 6 | 7 |
| Proportions of polyester dispersions (g) | H/AA = 150/350 | I/AA = 150/350 | J/AA = 150/350 | K/AA = 150/350 | L/AA = 150/350 | N/AA = 150/350 | AA = 500 |
| | Measurement results | | | | | | |
| Softening point (° C.) | 107.5 | 106.6 | 106.4 | 104.1 | 110.6 | 102.6 | 110.9 |
| Glass transition temperature (° C.) | 54.3 | 57.2 | 51.6 | 47.3 | 58.1 | 45.6 | 57 |
| Fusing ability | e | e | d | c | d | c | e |
| Pressure storage stability | e | d | e | e | e | e | b |

The toners obtained in Comparative Examples 1, 3, 4 and 6 were deteriorated in pressure storage stability owing to poor dispersibility of the crystalline polyesters used therein. The toner obtained in Comparative Example 5 was deteriorated in pressure storage stability owing to low crystallizability of the crystalline polyester used therein. In addition, the toners obtained in Comparative Examples 1 and 2 were deteriorated in fusing ability owing to high crystallization velocity of the crystalline polyesters used therein. Further, the toner obtained in Comparative Example 7 was also deteriorated in fusing ability owing to no use of the crystalline polyester. Meanwhile, the toner obtained in Example 13 was excellent in reproducibility of solid images as evaluated by the following method.

(Evaluation for Reproducibility of Solid Images)

Sixty grams of the obtained toner was loaded in a cyan toner cartridge, and the toner cartridge was mounted to a copying machine "MicroLine 5400" available from Oki Data Co., Ltd., from which a fixing device was previously dismounted. After images having a printing percentage of 5% were printed on 20 sheets of fixing paper "CopyBond SF-70NA" (available from Sharp Corp.; 75 g/m$^2$), images having a printing percentage of 100% (solid image) were successively printed on a sheet of the same fixing paper.

The resulting solid images on each printed paper were measured for their densities at total three points along a line extending apart 3 cm from an upper end of the paper, i.e., at a position of 5 cm inside from its right side, its central position and a position of 5 cm inside from its left side along the line, using a reflection-type densitometer "RD-915" available from Gretag Macbeth Corp., to calculate an average value of the thus measured densities.

In addition, the measurement of densities of the solid images on each printed paper was similarly carried out at other total three points along a line extending apart 5 cm from a lower end of the paper, i.e., at a position of 5 cm inside from its right side, its central position and a position of 5 cm inside from its left side along the line, using a reflection-type densitometer "RD-915" available from Gretag Macbeth Corp., to calculate an average value of the thus measured densities.

The average value of the densities as calculated at the upper and lower ends of each printed paper was 0.1 or less.

Example 14

Production of Toner Containing Core-Shell Particles

The mixed dispersion prepared by formulating the polyester dispersions A and AA produced in the above Production Examples, at a proportion (A/AA) of 150 g/350 g, 20 g of the colorant dispersion, 15 g of the wax dispersion, 7 g of the charge controlling agent dispersion and 1.5 g of a cationic surfactant ("SANISOL (registered trademark) B50" available from Kao Corp.) were charged into a round stainless steel flask, and mixed and dispersed therein using a homogenizer. The contents of the flask were heated to 48° C. in a heating oil bath while stirring, and further held at 48° C. for 1 h. As a result, it was confirmed that aggregated particles having a volume-median particle diameter of 5.1 μm were produced in the dispersion. Thereafter, 50 g of the polyester dispersion AA were added to the flask, and the contents of the flask were dispersed under stirring, thereby obtaining aggregated particles in the form of capsulated core-shell particles.

After adding 3 g of an anionic surfactant ("PELEX SS-L" available from Kao Corp.) to the dispersion containing the aggregated core-shell particles, a reflux tube was fitted to the stainless steel flask, and the contents of the flask were heated to 80° C. at a rate of 0.1° C./min while continuously stirring and then held at 80° C. for 5 h to unify and fuse the aggregated particles. Thereafter, the obtained dispersion was cooled and filtered to separate the resulting fused particles therefrom. The thus obtained fused particles were fully washed with ion-exchanged water and then dried, thereby obtaining fine colored resin particles. The thus obtained fine colored resin particles had a volume-median particle diameter ($D_{50}$) of 5.0 μm.

Next, the thus obtained fine colored resin particles were formed into a cyan toner in the same manner as in Example 1. The resulting cyan toner had a volume-median particle diameter ($D_{50}$) of 5.3 μm.

The results of measurements for softening point and glass transition temperature of the resulting cyan toner as well as the results of evaluation for fusing ability and pressure storage stability thereof are shown in Table 4.

TABLE 4

| | Example 14 |
|---|---|
| Proportions of polyester dispersions (g) | [A/AA = 150/350] + [AA = 50] |
| Measurement results | |
| Softening point (° C.) | 108.4 |
| Glass transition temperature (° C.) | 58.2 |
| Fusing ability | a |
| Pressure storage stability | a |

[Production Examples of Polyester Dispersions]

(Polyester Dispersion A')

Two hundred grams of the resin A produced in the above Production Example, and 100 g of a nonionic surfactant [polyoxyethylene lauryl ether (EO added: 9 mol); cloud point: 98° C.; HLB: 15.3] were melted at 140° C. in a 5 L stainless steel container while stirring with a paddle-shaped stirrer at a rate of 200 r/min. The contents of the container were stabilized at 95° C. as the temperature lower by 3° C. than the cloud point of the nonionic surfactant. Thereafter, while stirring the resulting mixture with a paddle-shaped stirrer at a rate of 200 r/min, 75.5 g of a sodium hydroxide aqueous solution (concentration: 5% by weight) as a neutralizing agent was dropped into the container. Successively, while stirring the resulting mixture with a paddle-shaped stirrer at a rate of 300 r/min, 1624.5 g in total of deionized water was dropped into the container at rate of 6 g/min. During the dropping, the temperature of the reaction system was maintained at 95° C. Then, the obtained reaction mixture was passed through a wire mesh having a 200 mesh screen (mesh size: 105 μm) to obtain a polyester dispersion A' containing fine resin particles.

As a result, it was confirmed that the resin particles (primary particles) contained in the thus obtained resin dispersion had a volume-median particle diameter ($D_{50}$) of 0.35 μm and a solid concentration of 12.0% by weight, and no resin components remained on the wire mesh.

(Polyester Dispersion AA')

Two hundred grams of the resin AA produced in the above Production Example, and 100 g of a nonionic surfactant [polyoxyethylene lauryl ether (EO added: 9 mol); cloud point: 98° C.; HLB: 15.3] were melted at 160° C. in a 5 L stainless steel container while stirring with a paddle-shaped stirrer at a rate of 200 r/min. The contents of the container were stabilized at 95° C. as the temperature lower by 3° C. than the cloud point of the nonionic surfactant. Thereafter, while stirring the resulting mixture with a paddle-shaped stirrer at a rate of 200 r/min, 75.5 g of a sodium hydroxide aqueous solution (concentration: 5% by weight) as a neutralizing agent was dropped into the container. Successively, while stirring the resulting mixture with a paddle-shaped stirrer at a rate of 300 r/min, 1624.5 g in total of deionized water was dropped into the container at rate of 6 g/min. During the dropping, the temperature of the reaction system was maintained at 95° C. Then, the obtained reaction mixture was passed through a wire mesh having a 200 mesh screen (mesh size: 105 μm) to obtain a polyester dispersion AA' containing fine polyester particles.

As a result, it was confirmed that the polyester particles (primary particles) contained in the thus obtained polyester dispersion AA' had a volume-median particle diameter ($D_{50}$) of 0.35 μm and a solid concentration of 12.0% by weight, and no resin components remained on the wire mesh.

Example 15

Production of Toner

The mixed dispersion prepared by formulating the polyester dispersions A' and AA' produced in the above Production Examples, at a proportion (A'/AA') of 60 g/140 g, 8 g of the colorant dispersion, 6 g of the wax dispersion, 2 g of the charge controlling agent dispersion and 52 g of deionized water were charged into a 2 L container. Next, 146 g of a 6.2 wt % ammonium sulfate aqueous solution was dropped into the container at room temperature over 30 min while stirring with a paddle-shaped stirrer at a rate of 100 r/min. Thereafter, the resultant dispersion was heated while stirring until reaching 50° C. at which the temperature was fixed, and then allowed to stand at 50° C. for 3 h, thereby forming aggregated particles. After thus forming the aggregated particles, a dilute solution prepared by diluting 4.2 g of a sodium polyoxyethylenedodecylethersulfate aqueous solution (solid content: 28% by weight) with 37 g of deionized water was added thereto. The obtained dispersion was heated to 80° C. at a rate of 0.16° C./min and maintained at 80° C. for 1 h from the time at which the temperature of the dispersion reached 80° C., and then the heating was stopped. The obtained dispersion was gradually cooled to room temperature, and then subjected to a suction filtration step, a washing step and a drying step to obtain toner mother particles.

Next, 2.0 parts by weight of a hydrophobic silica ("R972" commercially available from Nippon Aerogel Corp.; number-average particle size: 16 nm) were externally added to 100 parts by weight of the toner mother particles using a Henschel mixer to obtain a cyan toner. The obtained toner had a volume-median particle diameter ($D_{50}$) of 4.7 μm.

The results of measurements for softening point and glass transition temperature of the resulting cyan toner as well as the results of evaluation for fusing ability and pressure storage stability thereof are shown in Table 5.

TABLE 5

| | Example 15 |
|---|---|
| Proportions of polyester dispersions (g) | A'/AA' = 60/140 |
| Measurement results | |
| Softening point (° C.) | 108 |
| Glass transition temperature (° C.) | 57.4 |
| Fusing ability | a |
| Pressure storage stability | a |

The invention claimed is:

1. A toner comprising core-shell particles as a resin binder, wherein each of the core-shell particles comprises a core portion obtained by subjecting a crystalline polyester-containing aqueous dispersion and a non-crystalline polyester-containing aqueous dispersion to aggregation, wherein the crystalline polyester is produced by polycondensing an alcohol component containing 70 mol % or more of an aliphatic diol having 2 to 8 carbon atoms, based on the total content of the alcohol component in the crystalline polyester, with a carboxylic acid component containing 50 mol % or more of terephthalic acid, based on the total content of the carboxylic acid component in the crystalline polyester; and a shell portion comprising a non-crystalline polyester, wherein all the non-crystalline polyester are obtained by polycondensing a carboxylic acid component containing 10 mol % or more of terephthalic acid, based on the total content of the carboxylic acid component in the non-crystalline polyester, with an alcohol component, and wherein the carboxylic acid component containing 10 mol % or more of terephthalic acid, based on the total content of the carboxylic acid component in the non-crystalline polyester, is a carboxylic acid component containing 60 to 90 mol % of terephthalic acid.

2. The toner according to claim 1, wherein the aliphatic diol having 2 to 8 carbon atoms comprises 1,6-hexanediol and α,ω-linear alkanediol having 2 to 5 carbon atoms.

3. The toner according to claim 1, wherein the alcohol component of the crystalline polyester comprises 1,6-hexanediol, and a total molar amount of terephthalic acid and 1,6-hexanediol contained in the carboxylic acid component and the alcohol component of the crystalline polyester is from 75 to 95 mol % on the basis of a total molar amount of the carboxylic acid component and the alcohol component of the crystalline polyester.

4. The toner according to claim 1, wherein a content of the non-crystalline resin in the shell is 50 mass % or more.

5. The toner according to claim 1, wherein a content of the non-crystalline resin in the shell is 80 mass % or more.

6. The toner according to claim 1, wherein a content of the non-crystalline resin in the shell is 100 mass %.

* * * * *